US006402282B1

(12) United States Patent
Webb

(10) Patent No.: US 6,402,282 B1
(45) Date of Patent: Jun. 11, 2002

(54) OPERATION OF DROPLET DEPOSITION APPARATUS

(75) Inventor: Laura Anne Webb, Swavesey (GB)

(73) Assignee: XAAR Technology Limited, Cambridge (GB)

( * ) Notice: Subject to any disclaimer, the term of this patent is extended or adjusted under 35 U.S.C. 154(b) by 0 days.

(21) Appl. No.: 09/416,858

(22) Filed: Oct. 12, 1999

Related U.S. Application Data

(63) Continuation of application No. PCT/GB99/00450, filed on Feb. 12, 1999.

(30) Foreign Application Priority Data

Feb. 12, 1998 (GB) ..... 9802871

(51) Int. Cl.[7] ..... B41J 2/205
(52) U.S. Cl. ..... 347/15
(58) Field of Search ..... 347/10, 11, 15, 347/54, 56, 57, 70

(56) References Cited

U.S. PATENT DOCUMENTS 4,491,851 A * 1/1985 Mizuno et al. ..... 347/11
4,503,444 A 3/1985 Tacklind ..... 347/11
4,513,299 A 4/1985 Lee et al. ..... 347/15
5,689,291 A * 11/1997 Tence et al. ..... 347/10
5,736,994 A * 4/1998 Takahashi ..... 347/11
6,074,043 A * 6/2000 Anh ..... 347/54

FOREIGN PATENT DOCUMENTS

EP 0 721 840 A2 7/1996
EP 0 737 586 A1 10/1996

* cited by examiner

*Primary Examiner*—Anh T. N. Vo
(74) *Attorney, Agent, or Firm*—Marshall, Gerstein & Borun.

(57) ABSTRACT

Method of operating an inkjet printhead for printing on a substrate; the printhead having a chamber communicating with a nozzle for ejection of ink droplets and with a supply of ink; the printhead further comprising electrically actuable means associated with the chamber and actuable a plurality of times in accordance with print tone data, thereby to eject a corresponding number of droplets to form a printed dot of appropriate tone on the substrate; the method comprising the steps of applying a plurality of electrical signals to the electrically actuable means in accordance with the print tone data, the time delay between application of successive signals being such that any variation in the average velocity at which corresponding droplets travel to the substrate to form said printed dot remains below that which would lead to defects in the printed image detectable by the naked eye, regardless of the number of said droplets ejected to form said printed dot.

37 Claims, 9 Drawing Sheets

OPERATION OF DROPLET DEPOSITION APPARATUS

This is a continuation of International Application No. PCT/GB99/00450 filed Feb. 12, 1999, the entire disclosure of which is incorporated herein by reference.

FIELD OF THE INVENTION

The present invention relates to methods of operating droplet deposition apparatus, in particular an inkjet printhead, comprising a chamber communicating with a nozzle for ejection of ink droplets and with a supply of ink, the printhead further comprising electrically actuable means associated with the chamber and actuable a plurality of times to eject a corresponding number of droplets. In particular, it relates to a printhead in which the chamber is a channel having associated with it means for varying the volume of the channel in response to an electrical signal.

BACKGROUND OF THE INVENTION

Such apparatus is known, for example, from WO95/25011, U.S. Pat. No. 5,227,813 and EP-A-O 422 870 (all incorporated herein by reference) and in which the channels are separated one from the next by side walls which extend in the lengthwise direction of the channels. In response to electrical signals, the channel walls are displaceable transverse to the channel axis. This in turn generates acoustic waves that travel along the channel axis, causing droplet ejection as is well-known in the art.

The last of the aforementioned documents discloses the concept of "multipulse greyscale printing": firing a variable number of ink droplets from a single channel within a short period of time, the resulting "packet" of droplets merging in flight and/or on the paper to form a correspondingly variable-size printed dot on the paper. FIG. 1 is taken from the aforementioned EP-A-O 422 870 and illustrates diagrammatically droplet ejection from ten neighbouring printhead channels ejecting varying numbers (64,60,55,40,etc.) of droplets. The regular spacing of successive droplets ejected from any one channel indicates that the ejection velocity of successive droplets is constant. It will also be noted that this spacing Is the same for channels ejecting a high number of droplets as for channels ejecting a low number of droplets.

SUMMARY OF THE INVENTION

In the course of experiment, two deviations from the behaviour described in EP-A-O 422 870 have been discovered.

The first finding is that the first droplet to be ejected from a given channel is slowed by air resistance and may find itself hit from behind by subsequent droplets in the packet travelling In Its slipstream and therefore subject to less air drag. First and subsequent droplets of the packet may then merge to form a single, large drop.

The second finding is that the velocity of such a single, large drop will vary depending on the total number of droplets in the packet that are ejected in one go from a given channel.

A third finding relates to three-cycle operation of the printhead—described, for example in EP-A-O 376 532—in which successive channels in a printhead are alternately assigned to one of three groups. Each group is enabled in turn, with enabled channels ejecting a packet of one or more droplets in accordance with incoming print data as described above. It has been discovered that the velocity of the single, large drop formed by the merging of such droplets will vary depending on whether the adjacent channel in the same group is also being operated (i.e. 1 in 3 channels) or whether only the next-but-one channel in the same group is being operated (i.e. 1 in 6 channels).

The variations in velocity outlined above can give rise to significant dot placement errors which, although a known problem per se, can be particularly critical in printheads operating in the multipulse greyscale mode explained above. Here the present inventors have established that a placement error between two or more printed dots that is above one quarter of a pixel pitch can lead to print defects that are detectable by the naked eye. Since multipulse greyscale printheads typically operate at a printing pitch of 360 dots per inch and minimum substrate speeds, packet firing frequencies and printhead-substrate separations of 5 m/s, 5kHz and 1 mm respectively, this places an upper limit of 1.25 m/s on the acceptable variation in speed between the droplets that go to form any two adjacent printed dots.

BRIEF DESCRIPTION OF THE DRAWINGS

The present invention has a s an objective the avoidance of the aforementioned dot placement error s when generated by the phenomena described above and will now be described by way of example by reference to the following diagrams, of which.

DETAILED DESCRIPTION OF THE PREFERRED EMBODIMENTS

Figure 1:
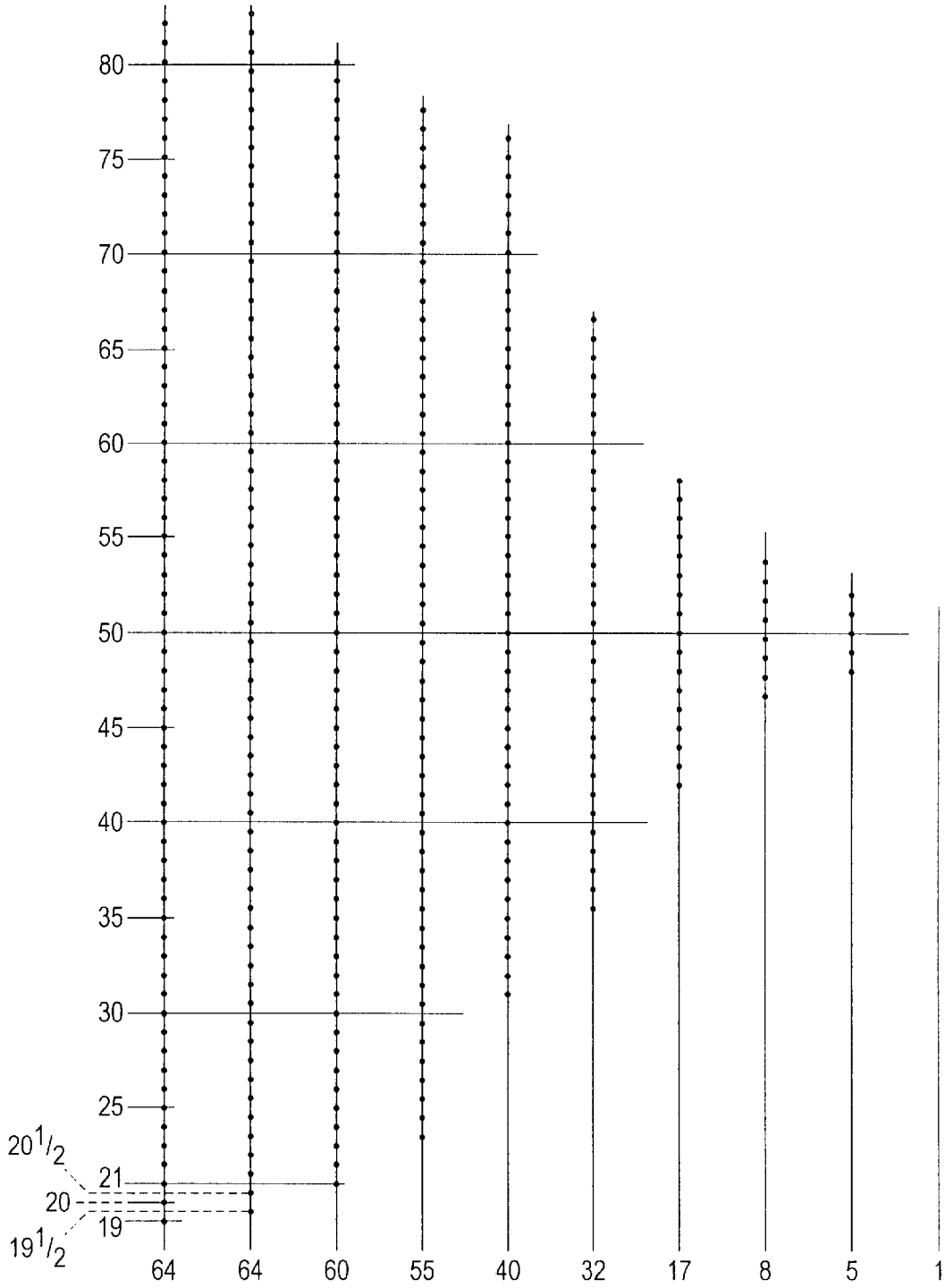
Fig. 1 PRIOR ART
FIG. 1 illustrates a diagram of droplet ejection from ten neighboring printhead channels ejecting varying numbers of droplets.
Figure 2:
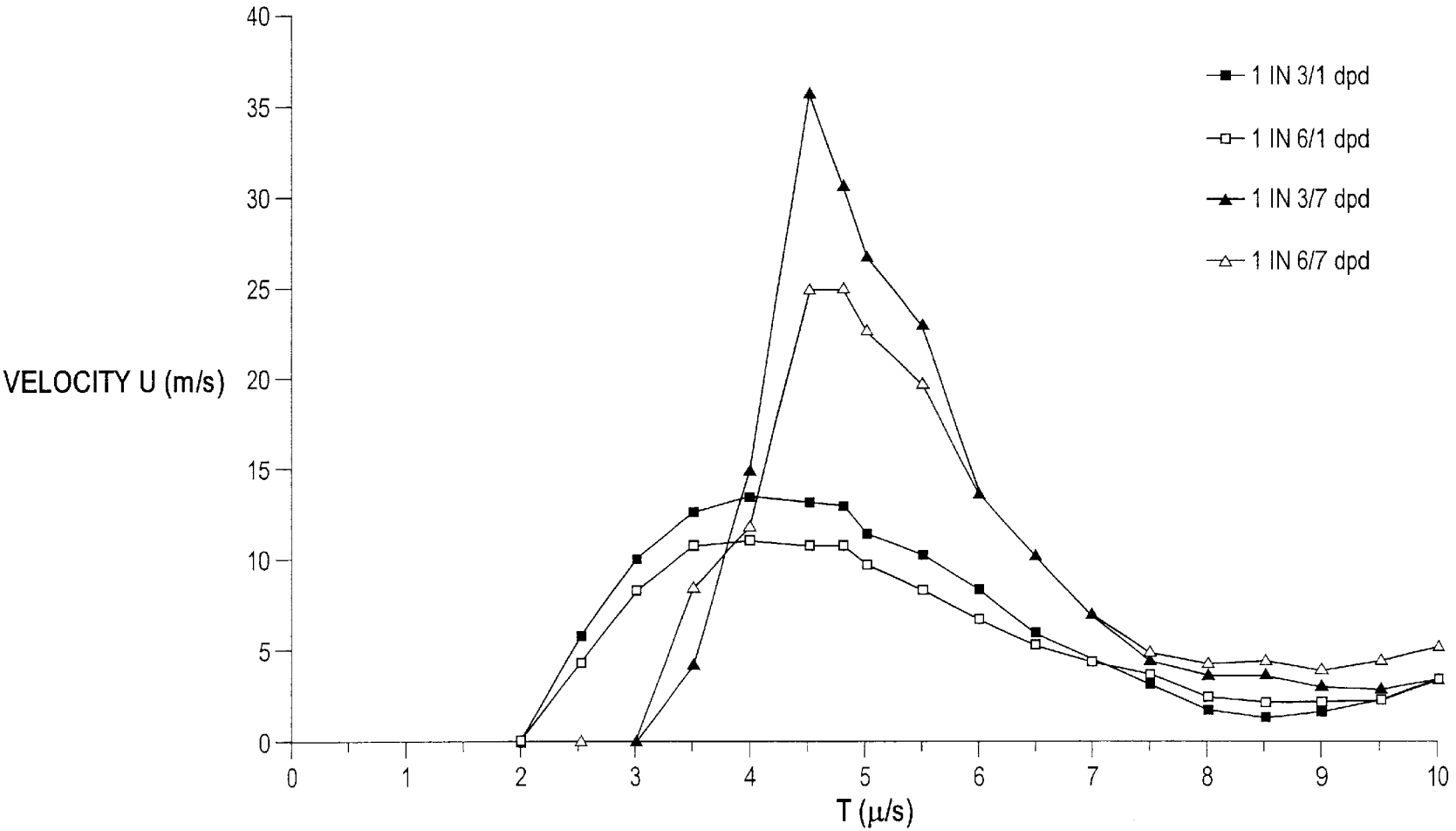
FIG. 2 illustrates variation in droplet velocity with total waveform duration.
Figure 3A:
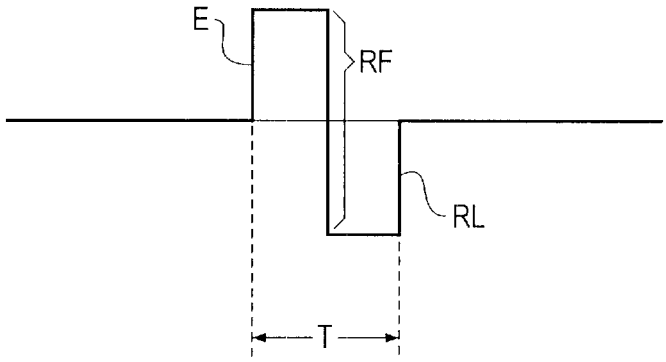
FIG. 3*a* illustrates the waveform used in obtaining the results of FIG. 2.

FIG. 2 illustrates the variation in drop velocity with total duration T of a draw-reinforce-release (DRR) waveform applied repeatedly to the channel of a printhead of the kind mentioned above to generate a packet of droplets. Such a waveform—well known in the art—is illustrated in FIG. 3*a* and places a printhead channel initially in an expanded condition (a "draw" as at E), subsequently switches to a contracted condition (a "reinforce" as at RF) and then "releases" (as at RL) the channel back to its original, non-actuated, rest condition. As shown in FIG. 3*a*, the draw and reinforce periods of the waveform used to obtain FIG. 2 are equal and repetition of the waveform results in the ejection of one droplet.

Figure 3B:
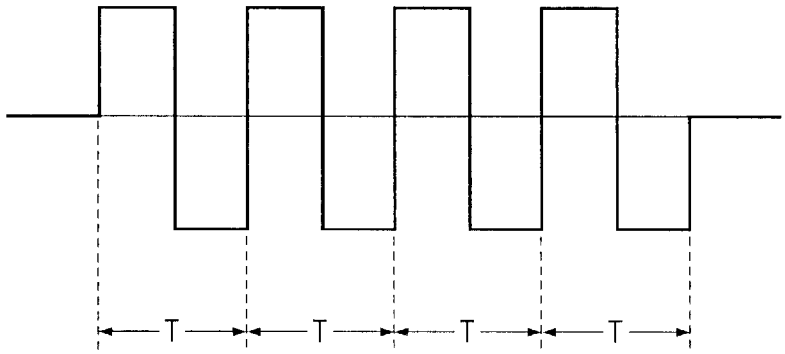
FIG. 3*b* illustrates the application of a number of the waveforms of FIG. 3 in succession.

FIG. 3*b* depicts the application of the waveform several times in immediate succession so as to eject several droplets ("droplets per dot" or "dpd") from a channel so as to form a correspondingly sized dot on the paper. It will be appreciated that this step is repeated for each channel every time the group to which it belongs is enabled and the incoming print data is such that it is required to print a dot. In the experiment used to obtain the data shown in FIG. 2, channels were repeatedly enabled—and dots were printed—at a frequency of 60 Hz.

As explained above, the droplets in a packet ejected from a channel may all merge in flight to form a single, large drop that hits the substrate to be printed. Alternatively, all droplet merging may take place at the substrate. In a third regime, all the droplets in a packet merge in flight with the exception of the first droplet of the packet which travels ahead of the large, merged drop.

FIG. 2 does not distinguish between these various modes, instead indicating the velocity of the first drop(let) to hit the substrate as measured at the substrate. It will be seen that the application of a single DRR waveform (1 dpd) of around 4.5 μs duration (to eject a single droplet) will result in a velocity of approximately 12 m/s per second if only alternate channels in a group are fired (1 in 6 operation) whereas a velocity of around 14 m/s results if every channel in a group is fired (1 in 3 operation). However, applying the same waveform seven times in immediate succession (7 dpd) so as to eject seven droplets results in a velocity of around 37 m/s when operated "1 in 3" and a velocity of around 25 m/s when operated "1 in 6".

It has been discovered that there are certain advantageous values of total waveform duration T at which the aforementioned variation in velocity is much reduced. In the case of FIG. 2, it will be seen that by operating a printhead with a waveform of approximately 3.8 μs duration, the velocity remains fairly constant at around 12 m/s regardless of the number of droplets ejected in one go or the firing/non-firing status of adjacent channels in the same group. Similarly, operation with a waveform of around 7.5 μs or greater will result in a fairly constant velocity although, at only 4 m/s, this is less desirable since a droplet ejection velocity of at least 5 m/s, and preferably at least 7 m/s, has been found necessary for acceptable print quality. Furthermore, greater values of T also result in a greater waveform duration overall and a correspondingly lower dot printing rate.

FIG. 2 was obtained using a printhead of the kind disclosed in the aforementioned WO95/25011 and having a resonant frequency of approximately 250 kHz, equivalent to a period of resonance of approximately 4 μs. This is reflected in the "1 in 3/1 dpd" trace of FIG. 2 which shows a resonant peak in the velocity, U, of droplets ejected from the printhead when the period of the actuating waveform is equal to 4 μs, corresponding in turn to compression and expansion elements of the actuating waveform each being equal to 2 μs. As explained in WO95/25011, such a resonant period has in the past been considered as being equal to twice the ratio of closed channel length (L) to the velocity of pressure waves in the ink (c). Consequently, the notation L/c is used hereinafter to denote half the resonant period and, so expressed, the advantageous values referred to above are 1.9 L/c and >3.75 L/c respectively.

It should be noted that at 2 μs, this half resonant period is significantly shorter than in similar printheads designed to eject a single ink droplet in any one droplet ejection period—so-called "binary" printing—in which require a greater channel length L to achieve the necessary greater droplet volume. The corresponding reduction in maximum droplet ejection frequency is offset by the fact that only one—rather than a plurality—of drops need be ejected to form the printed dot on the substrate. In contrast, "multipulse greyscale" operation—in which a plurality of droplets form the printed dot—typically requires a printhead in which the half resonant period has a value not exceeding 5 μs, preferably not exceeding 2.5 μs, in order that sufficiently high repetition frequencies and, secondarily, sufficiently low droplet volumes can be achieved.

While the aforementioned advantageous values of waveform duration will vary with printhead design, actuation waveform, and dot printing frequency, the manner in which they are determined—namely from a graph of the kind shown in FIG. 2—will remain the same The same holds for the value of resonant period for a printhead. For various values of actuation waveform duration T, velocity data U is obtained either from analysis of the landing positions of ejected droplets on a substrate moving at a known speed or—preferably—by observation of droplet ejection stroboscopically under a microscope. It will be appreciated that both methods give an indication of the average velocity of the droplet in the course of its journey between nozzel and substrate.

As mentioned above, the "DRR" waveform shown in FIG. 3*a* need not necessarily have channel contraction and expansion elements that are equal in duration and/or amplitude. Indeed, it is believed that the duration of the expansion element of the waveform may have more influence on the behaviour discussed above than the duration of the actuation waveform as a whole.

Figure 4:
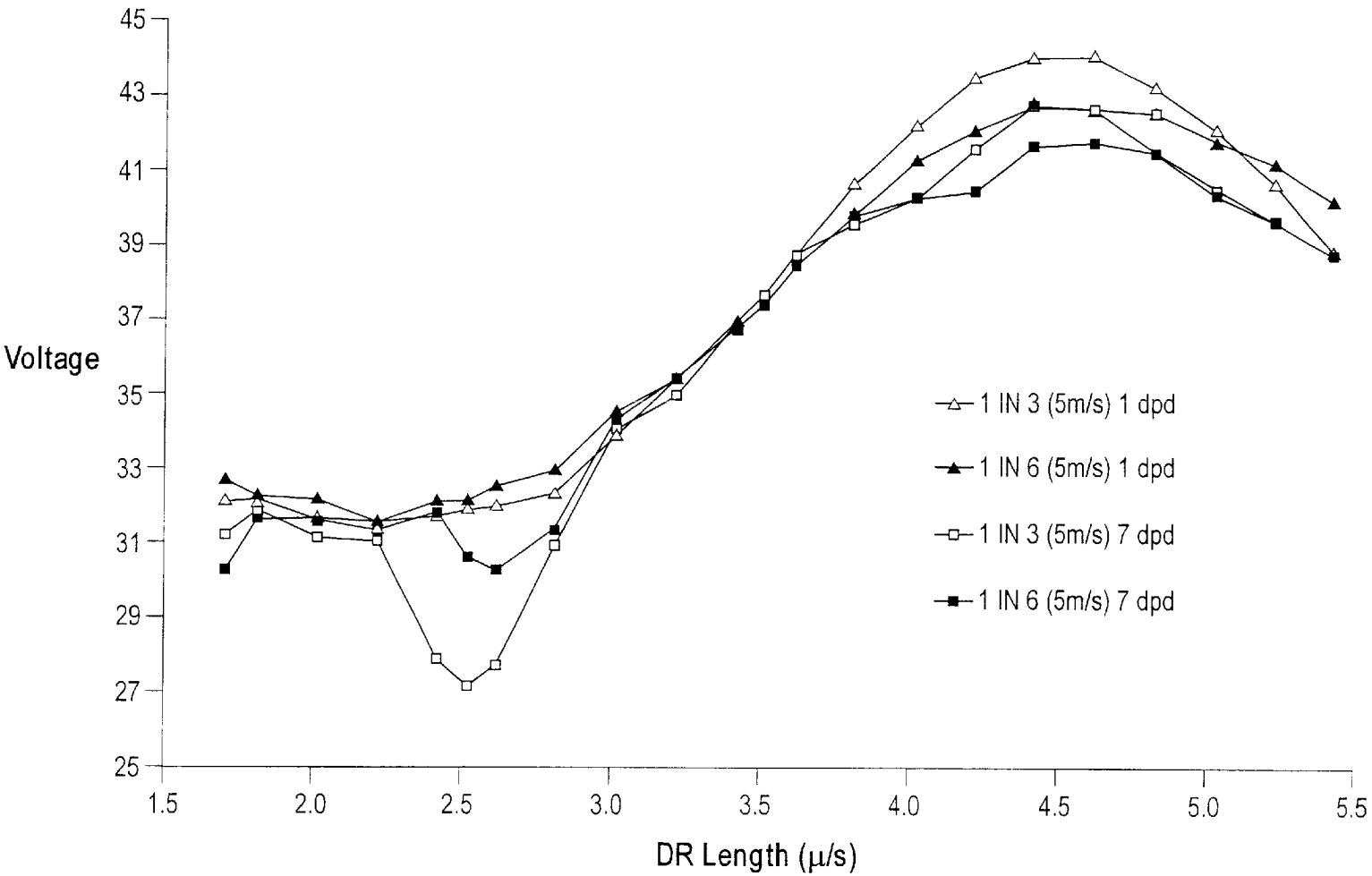
FIG. 4 illustrates variation in droplet velocity with the duration of waveform expansion period.

FIG. 4 illustrates the variation with increasing expansion period duration (DR) of the peak-to-peak waveform amplitude (V) necessary to achieve a droplet ejection velocity (U) of 5 m/s. As with FIG. 2, the printhead was of the kind disclosed in WO95/25011 and having a resonant period, 2 L/c, of approximately 4.4 μs.

It will be seen that at values of expansion period duration (DR) of around 2.5 μs and 4.5 μs, different values of waveform amplitude V are necessary depending on the droplet firing regime. In the case of DR=2.5 μs, a peak-to-peak waveform amplitude (V) of only 27 volts is required when applying the waveform seven times in immediate succession so as to eject seven droplets (7 drops per dot (dpd)) from one in every three channels ("1 in 3" operation) in multipulse greyscale printing mode. In contrast, a value of V=32 volts is necessary to achieve the same droplet ejection velocity when applying the waveform only once so as to eject a single droplet (1 drop per dot (dpd)) from one in every six channels ("1 in 6" operation).

In practice, variation of waveform amplitude with droplet firing regime would require complex—and thus expensive—control electronics. The alternative solution of a constant waveform amplitude, whilst simpler and cheaper to implement, would give rise to variations in droplet ejection velocity and consequential droplet placement errors as discussed above.

The present inventors have discovered, however, that there are values of expansion period duration (DR) at which the droplet ejection velocity remains substantially constant regardless of the droplet firing regime. Operation in such ranges allows waveforms of constant amplitude to be used regardless of operating regime and therefore without the risk of droplet placement errors.

In the case of FIG. 4, for example, such constant behaviour occurs with values of DR in the approximate ranges 1.8 μs–2.2 μs, with particularly close agreement between velocities being achieved at around 2.2 μs, and in the range 3.0 μs–3.6μs, particularly 3.4 μs. Expressed in terms of half resonant period, L/c, these ranges are approximately 0.8 L/c–1.0 L/c, particularly 1 L/c, and 1.4 L/c–1.6 L/c, particularly 1.5 L/c. Operation in the lower rather than the higher range gives a lower overall waveform duration which in turn allows a higher waveform repetition frequency. The lower operating voltage for a given droplet speed in the 1.8 μs–2.2 μs range also gives rise to correspondingly lower heat generation in the piezoelectric material of the printhead actuator walls. For these reasons, operation in the lower range is to be preferred.

It should be appreciated that printhead characteristics obtained for a constant droplet ejection velocity (U), as shown in FIG. 4, will include consistent fluid dynamic effects such as nozzle and ink inlet impedance which are themselves known, for example, from WO92/12014 incorporated herein by reference. The characteristics will incorporate viscosity variations, however, brought about by a variation in heating of the ink by the piezoelectric material of the printhead with variation in waveform amplitude (V). Piezoelectric heating of ink in a printhead is explained in WO97/35167, incorporated herein by reference, and consequently will not be discussed in further detail here.

Conversely, printhead characteristics of the kind shown in FIG. 2 and obtained for a constant waveform amplitude (V) will include consistent heating effects at the expense of varying fluid dynamic effects. It will be appreciated, however, that at those operating conditions according to the present invention whereby waveform amplitude and droplet ejection velocity remain constant regardless of operating regime, fluid dynamic and piezoelectric heating effects will also remain constant. Consequently either type of characteristic is suitable in determining operating conditions according to the present Invention.

Figure 5:
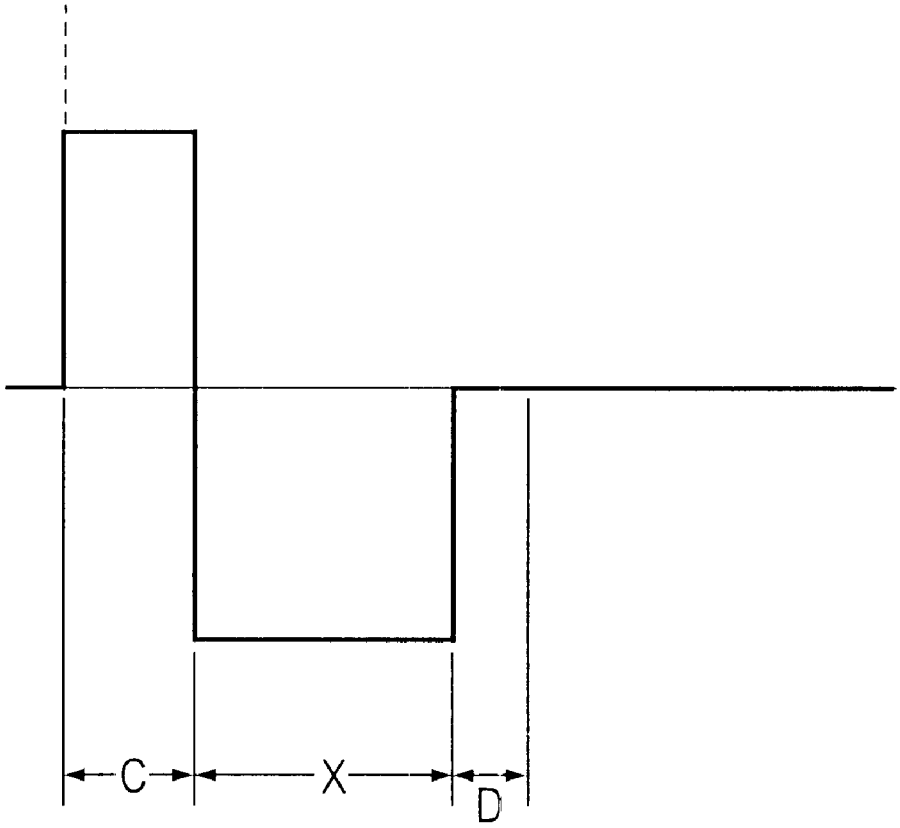
FIG. 5 illustrates an actuating waveform according to the present invention

FIG. 5 illustrates the actuating waveform used in obtaining the characteristics of FIG. 4, with actuating voltage magnitude being indicated on the ordinate and normalised time on the abscissa. At "C" is indicated the channel expansion period, the duration (DR) of which is varied to obtain the characteristics of FIG. 6. There follows substantially immediately thereafter a channel contraction period "X" of duration of 2DR, followed by a period "D" of duration 0.5DR in which the channel dwells in a condition in which it is neither contracted nor expanded. Following the dwell period, the waveform can be repeated as appropriate to eject further droplets. Such a waveform has been found to be particularly effective in ejecting multiple droplets to form a single, variable-size dot on a substrate without simultaneously causing the ejection of unwanted droplets (so-called "accidentals") from neighbouring channels.

Accordingly, a first aspect of the present invention consists in a method of operating droplet deposition apparatus, the apparatus comprising a channel communicating with a nozzle for droplet ejection and with a supply of droplet fluid; there being associated with the channel means for varying the volume of the channel in response to an electrical signal; the method comprising the steps of: applying a signal having a first part to hold the volume of said channel in an increased state for a first time period and a second part to hold the volume of said channel in a decreased state for a second time period substantially immediately following said first time period, and repeatedly applying said signal with a time delay between successive signals equal to substantially half of said first time period.

Furthermore, waveforms of this kind having a particular value of dwell time have been found to be effective in reducing the difference in velocity between single droplet (1 dpd) and multiple droplet (e.g. 7 dpd) operation to below the level necessary for acceptable image quality.

Thus a second aspect of the present invention consists in a method of operating an inkjet printhead for printing on a substrate; the printhead having a chamber communicating with a nozzle for ejection of ink droplets and with a supply of ink; the printhead further comprising electrically actuable means associated with the chamber and actuable a plurality of times in accordance with print tone data, thereby to eject a corresponding number of droplets to form a printed dot of appropriate tone on the substrate; the method comprising the steps of: applying a plurality of electrical signals to the electrically actuable means in accordance with the print tone data, the time delay between application of successive signals being such that any variation in the average velocity at which corresponding droplets travel to the substrate to form said printed dot remains below that which would lead to defects in the printed image detectable by the naked eye, regardless of the number of said droplets ejected to form said printed dot.

The present inventors have found that with the aid of suitable experiments covering a range of dwell times, a dwell time value can be found at which the average velocity of the droplets in a packet remains within a narrow band, regardless of the number of droplets in that packet. As a result, any variation in the average velocity that does take place between droplet packets of varying size will be less than that which would otherwise give rise to defects in the printed image detectable by the naked eye as explained earlier.

Preferred embodiments of both aspects of the invention are set out in the description and dependent claims. The invention also comprises droplet deposition apparatus and drive circuit means adapted to operate according to these claims.

Figure 6:
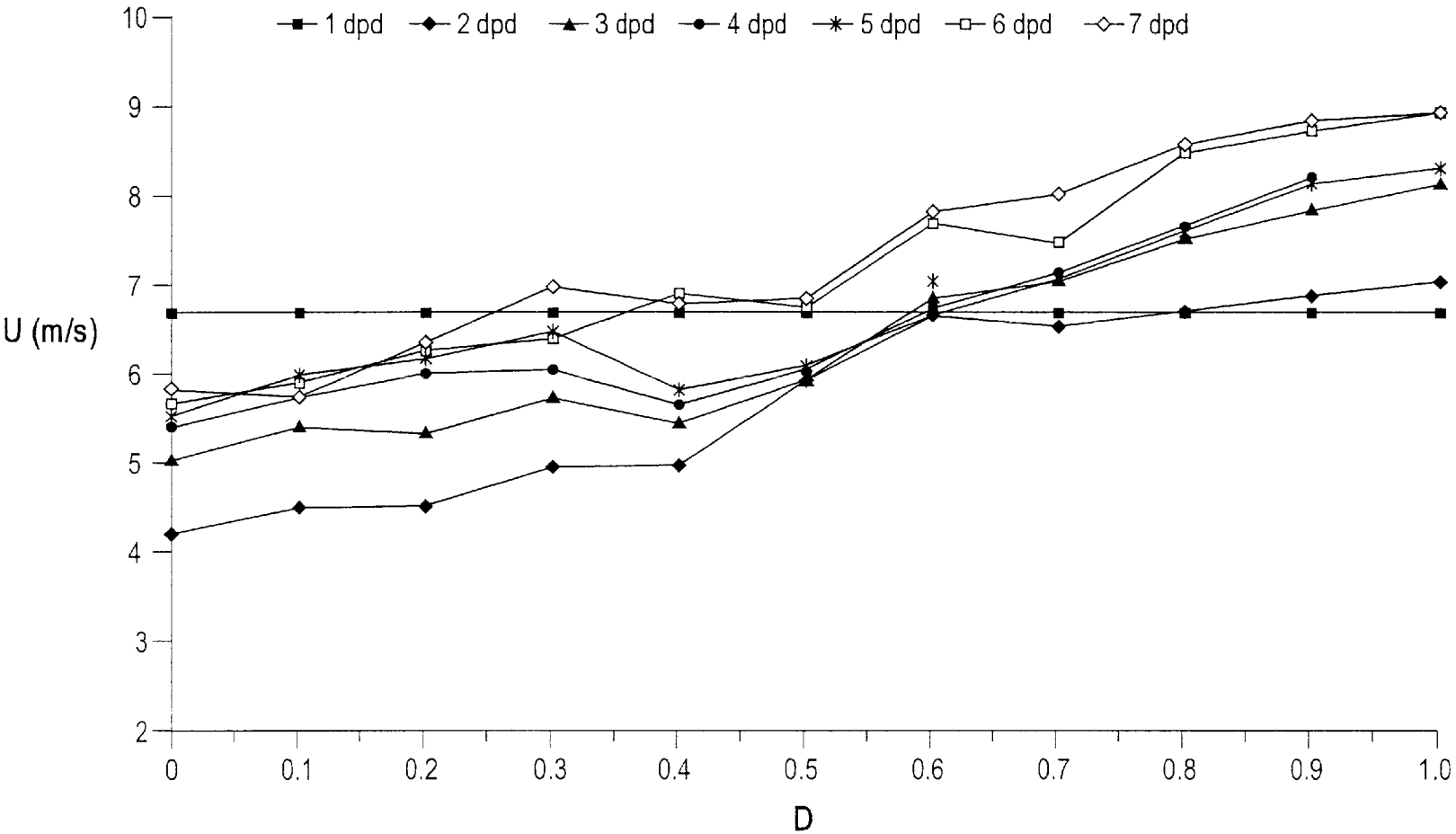
FIG. 6 illustrates variation in droplet velocity with duration of waveform dwell period.

FIG. 6 illustrates the results of an experiment of the kind referred to above, the variation in average droplet velocity, U, being plotted against variation in the length of the dwell period D of a waveform of the kind shown in FIG. 5. The length of D is expressed as a fraction of the length DR of the expansion period C which, in the present example, has a length of 2.2 μs and is equal to half the resonant period. Compression period X is twice the length of C, as shown in FIG. 5.

It will be seen that the waveform of the kind described above in which the dwell time is equal to 0.5DR results in a separation of only 0.7 m/s between a maximum velocity of approximately 6.7 m/s, corresponding to a packet of 7 droplets, and a minimum velocity of 6 m/s corresponding to a packet of two droplets. This is little over half of the allowable difference of 1.25 m/s mentioned above. It is also evident from FIG. 8 that it would be possible to reduce the dwell time to 0.45DR before exceeding the 1.25 m/s limit on velocity difference mentioned earlier, resulting in a shorter—and therefore faster—overall waveform. It is also possible to increase the dwell time a similar amount above 0.5DR—to a dwell time of 0.55—without any significant deleterious effects. Indeed, the slower rate of increase in velocity difference with dwell time at values of dwell above 0.5DR means that the 1.25 m/s limit is reached at values of DR around 0.85. A waveform incorporating such a dwell period would only have approximately 90% of the speed of a waveform incorporating a 0.45 DR dwell period, however, and is consequently less desirable.

The results of FIGS. 4 and 6 were obtained using a waveform of the kind shown in FIG. 5 having an amplitude in the region of 40V. It will be appreciated, however, that constraints elsewhere in the system may result in a somewhat altered waveform being applied in practice. In particular, rise times in the drive circuitry may result in waveform edges having a greater slope than illustrated in FIG. 5 or in a slight dwell time between application of expansion and contraction signals. In the latter case, any dwell time will be significantly less than the dwell time between signals.

In addition to having a half resonant period of approximately 4.4 $\mu$s, the printhead used to obtain the results of FIGS. 4 and 6 also had a nozzle outlet diameter of 25 $\mu$m and employed a hydrocarbon ink of the kind disclosed in WO96/24642. Other parameters were typical, for example as disclosed in the EP 0 609 080, EP 0 611 154, EP 0 611 655 and EP 0 612 623. It will be appreciated, however, that experiments of the kind mentioned in regard to FIG. 6 can be performed with any printhead and suitable values of dwell period thereby established.

Inkjet printing apparatus having a multiplicity of closely spaced parallel ink channels and channel separating piezoelectric displaceable wall actuators have been disclosed for example in U.S. Pat. Nos. 4,879,568 and 4,887,100. In such apparatus, each channel is actuable by one or both of the displaceable side walls In a typical arrangement, an external connection is provided which relates to each channel and when a voltage difference is applied between the electrode corresponding to one channel and the electrodes of the neighboring channels, the walls adjacent to the channel are displaced causing the volume of the center channel, depending on the voltage sign, to expand or to contract and an ink drop to be ejected from the nozzle communicating with the channel.

Figure 7:
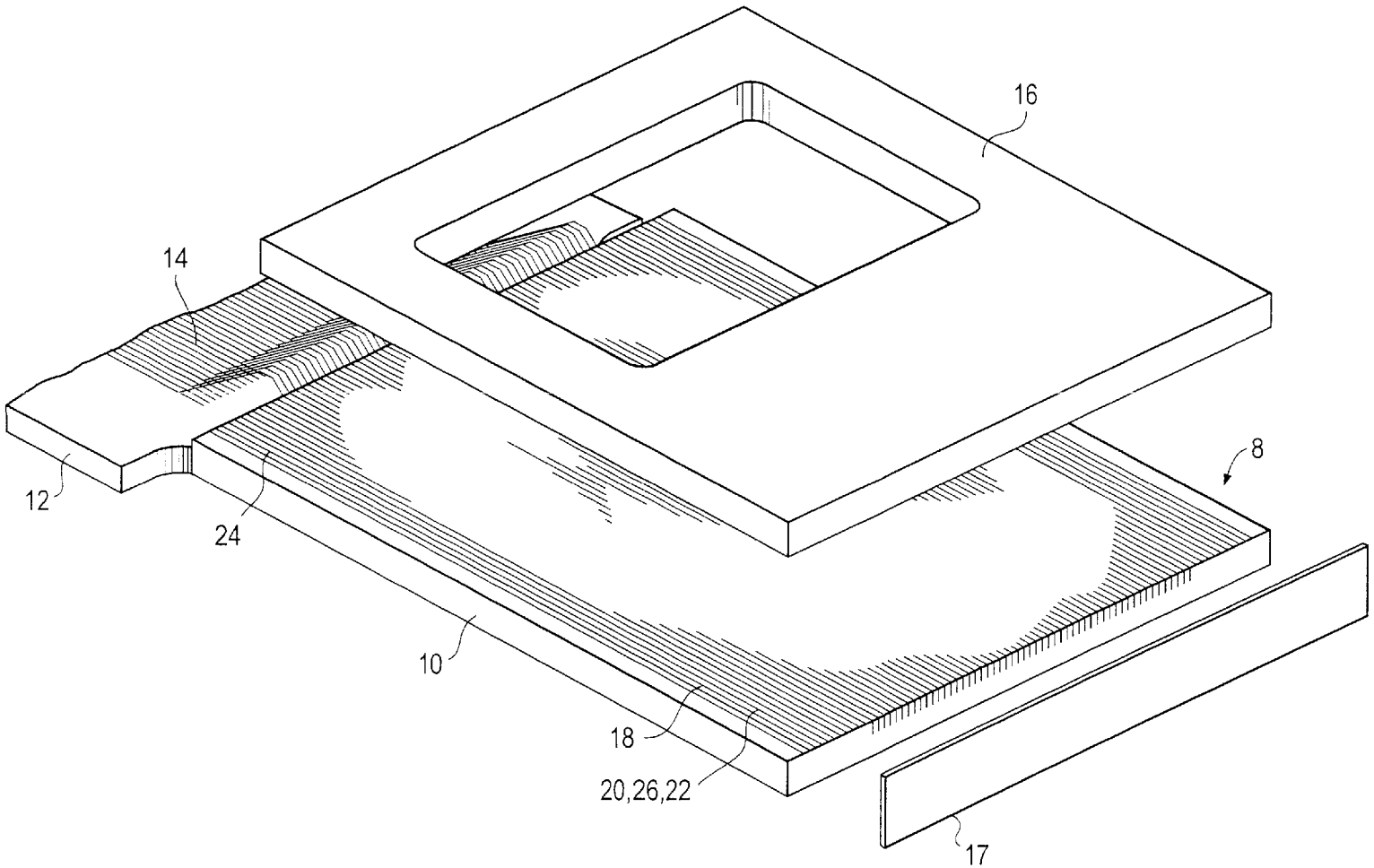
FIG. 7 illustrates an exploded view in one perspective of one form of an inkjet printhead incorporating piezoelectric wall actuators operating in shear mode and comprising a printhead base, a cover, and a nozzle plate.

FIG. 7 shows an exploded view in perspective of a typical inkjet printhead 8 incorporating piezoelectric wall actuators operating in shear mode. It comprises a base 10 of piezoelectric material mounted on a base or circuit board 12 of which only a section showing connection tracks 14 is illustrated. A cover 16, which is bonded during assembly to the base 10 is shown above its assembled location. A nozzle plate 17 is also shown adjacent the printhead base.

A multiplicity of parallel grooves 18 are formed in the base 10 extending into the layer of piezoelectric material. The grooves are formed for example as described in U.S. Pat. No. 5,016,028 and comprise a forward part in which the grooves are comparatively deep to provide ink channels 20 separated by opposing actuator walls 22. The grooves in the rearward part are comparatively shallow to provide locations for connection tracks. After forming the grooves 18, metallized plating is deposited in the forward part providing electrodes 26 on the opposing faces of the ink channels 20 where it extends approximately one half of the channel height from the tops of the walls and is deposited in the rearward part providing connection tracks 24 connected to the electrodes in each channel 20. The tops of the walls are kept free of plating metal so that the track 24 and the electrodes 26 form isolated actuating electrodes for each channel.

After the deposition of metallized plating and coating of the base 10 with a passivant layer for electrical isolation of the electrode parts from the ink, the base 10 is mounted as shown in FIG. 7 on the circuit board 12 and bonded wire connections are made connecting the connection tracks 24 on the base part 10 to the connection tracks 14 on the circuit board 12.

Figure 8:
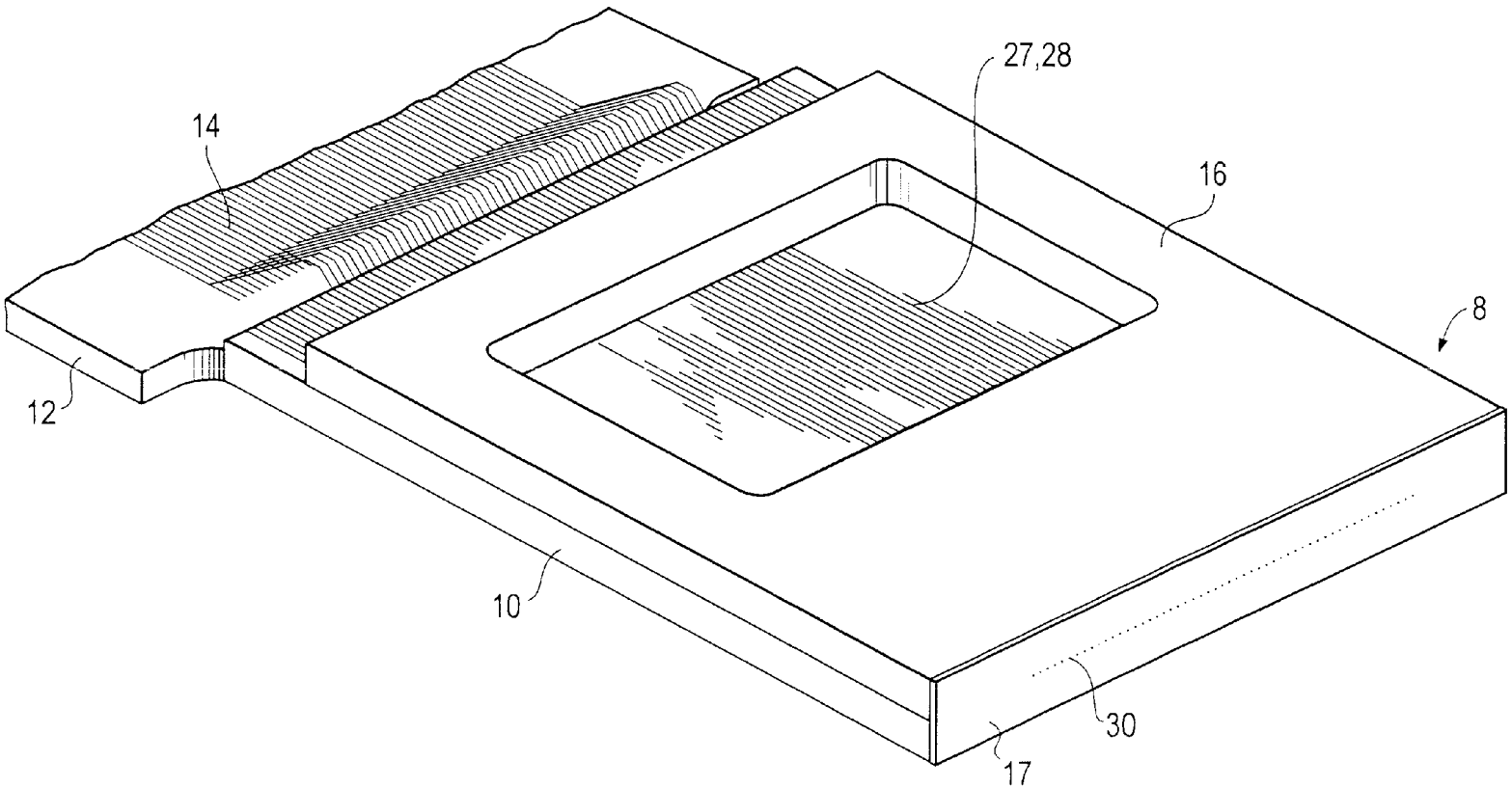
FIG. 8 illustrates the printhead of FIG. 7 in perspective and after assembly.

The inkjet printhead 8 is illustrated after assembly in FIG. 8. In the assembled printhead, the cover 16 is secured by bonding to the tops of the actuator walls 22 thereby forming a multiplicity of closed channels 20 having access at one end to the window 27 in the cover 16 which provides a manifold 28 for the supply of replenishment ink. The nozzle plate 17 is attached by bonding at the other end of the ink channels. The nozzles 30 are shown in locations in the nozzle plate communicating to each channel formed by UV excimer laser ablation.

Figure 9:
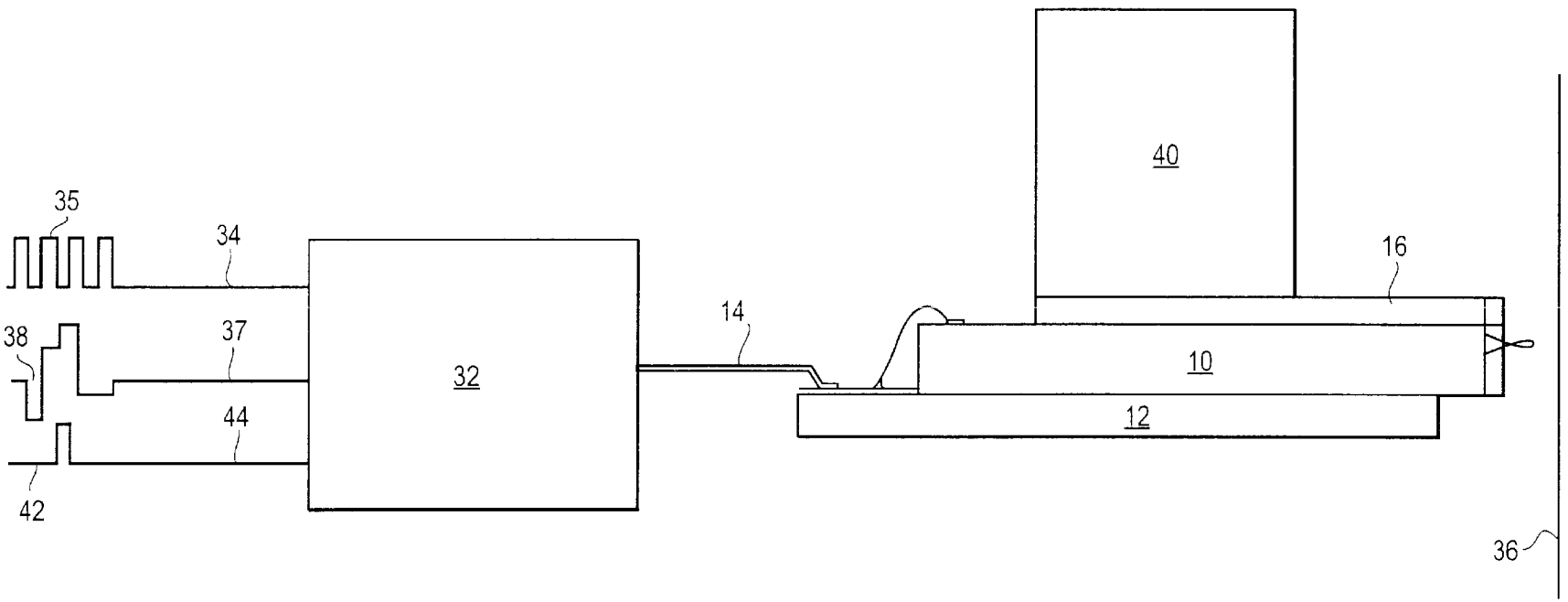
FIG. 9 illustrates a drive circuit connected via connection tracks to the printhead to which are applied a drive voltage waveform, timing signals and print data for the selection of ink channels, so that on application of the waveform, drops are ejected from the channels.

The printhead is operated by delivering ink from an ink cartridge via the ink manifold 28, from where it is drawn into the ink channels to the nozzles 30 by capillary suction. The drive circuit 32 connected to the printhead is illustrated in FIG. 9. In one form it is an external circuit connected to the connection tracks 14, but in an alternate form (not shown) an integrated circuit chip may be mounted on the printhead. The drive circuit 32 is operated by applying by a data link 34 the print data 35 defining print locations in each print line as the printhead is scanned over a print surface 36 and at the same time applying an actuating voltage waveform 38 via the signal link 37.

On receipt of a clock pulse 42 via timing link 44 the voltage waveform 38 is applied selectively via the chip and the connection tracks 14 to selected ones of the electrodes 26 in each channel selected for operation to effect drop ejection therefrom.

Whilst specific reference has been made to the apparatus described in WO95/25011 and other documents referred to above, the present invention is considered to be applicable to any printhead employing channels having displaceable side walls. Moreover, some of the advantages set forth above can be enjoyed by applying the present invention to drop-on-demand ink jet apparatus employing other electrically actuable means to eject droplets.

What is claimed is:

1. Method of operating an inkjet printhead for printing on a substrate; the printhead having a chamber communicating with a nozzle for ejection of ink droplets and with a supply of ink;

the printhead further comprising electrically actuable means associated with the chamber and actuable in accordance with print tone data, thereby to eject ink droplets to form a printed dot of appropriate tone on the substrate;

the method comprising the steps of:

applying two or more successive electrical signals to the electrically actuable means in accordance with the print tone data to effect ejection of two or more successive corresponding droplets, each corresponding to one of the successive signals, a time delay between application of the successive signals being such that any variation in an average velocity at which the corresponding droplets travel to the substrate to form said printed dot remains below that which would lead to droplet placement errors in a printed image detectable by an individual viewing the printed image, regardless of how many of the corresponding droplets are ejected to form said printed dot.

2. Method according to claim 1, wherein the time delay between application of the successive signals is such that the average velocity at which the corresponding droplets travel to the substrate does not vary by more than 1.25 m/s.

3. Method according to claim 2, wherein said average velocity does not vary by more than 0.7 m/s.

4. Method according to claim 1, wherein said electrically actuable means are adapted to vary a volume of the chamber, thereby to effect droplet ejection.

5. Method according to claim 4, wherein a signal is applied and comprises a first part to hold the volume of said chamber in an increased state for a first time period and a second part to hold the volume of said chamber in a decreased state for a second time period substantially immediately following said first time period.

6. Method according to claim 5, wherein said time delay is equal to substantially half of said first time period.

7. Method according to claim 6, wherein the ratio of said time delay to said first period is greater than or equal to 0.45.

8. Method according to claim 6, wherein the ratio of said time delay to said first period is less than 0.85.

9. Method according to claim 8, wherein the ratio of said time delay to said first period is equal to or less than 0.55.

10. Method according to claim 5, wherein said second time period is substantially equal to twice said first time period.

11. Method according to claim 1, wherein said chamber is a channel.

12. Method according to claim 11, wherein said first time period is equal to a half resonant period of said channel.

13. Method according to claim 10, wherein the half resonant period is less than or equal to 5 $\mu$s.

14. Method according to claim 13, wherein the half resonant period is substantially equal to 2.2 $\mu$s.

15. Method according to claim 1 and wherein the printhead has an array of said chambers; the method further comprising the steps of:

applying said successive electrical signals at a frequency such that a velocity of the corresponding droplets is both substantially independent of whether or not other chambers in the array of said chambers are similarly actuated to effect drop ejection simultaneously with drop ejection from a selected chamber and substantially independent of a number of the corresponding droplets to be ejected in accordance with the print tone data.

16. Method according to claim 15, wherein successive chambers in the array of said chambers are regularly assigned to groups such that a chamber belonging to any one group is bounded on either side by chambers belonging to at least one other group; the groups of chambers being sequentially enabled for actuation in successive periods;

and wherein said successive electrical signals are applied at a frequency such that the velocity of the corresponding droplets is both substantially independent of whether or not those chambers belonging to the same group as the selected chamber and which are located nearest in the array of said chambers to said selected chamber are similarly actuated to effect droplet ejection simultaneously with droplet ejection from the selected channel, and substantially independent of the number of the corresponding droplets to be ejected in accordance with the print tone data.

17. Method according to claim 1 and wherein the printhead has an array of said chambers; the method further comprising the steps of:

applying a plurality of the successive electrical signals to the electrically actuable means of a selected chamber in accordance with the print tone data, each of the plurality of the successive electrical signals being held at a given non-zero level for a period having a duration, the duration of the period being such that a velocity of the corresponding ejected droplet is both substantially independent of whether or not other chambers in the array of said chambers are similarly actuated to effect droplet ejection simultaneously with droplet ejection from the selected chamber, and substantially independent of a number of the corresponding droplets to be ejected in accordance with the print tone data.

18. Method according to claim 17, wherein successive chambers in the array are regularly assigned to groups such that a chamber belonging to any one group is bounded on either side by chambers belonging to at least one other group; the groups of chambers being sequentially enabled for actuation in successive periods; each electrical signal being held at a given non-zero level for a period, the duration of the period being chosen such that the velocity of the corresponding ejected droplet is both substantially independent of whether or not those channels belonging to the same group as the selected channel and which are located nearest in the array to said selected channel are similarly actuated to effect droplet ejection simultaneously with drop ejection from the selected channel, and substantially independent of the number of droplets to be ejected in accordance with the print tone data.

19. Method of operating droplet deposition apparatus, the apparatus comprising a channel communicating with a nozzle for droplet ejection and with a supply of droplet fluid;

there being a means associated with the channel for varying a volume of the channel in response to an electrical signal;

the method comprising the steps of:

applying a signal having a first part to hold the volume of said channel in an increased state for a first time period and a second part to hold the volume of said channel in a decreased state for a second time period substantially immediately following said first time period, and repeatedly applying said signal with a time delay between successive ones of said signal equal to substantially half of said first time period to form a printed dot.

20. Method according to claim 19, wherein the ratio of said time delay to said first period is greater than or equal to 0.45.

21. Method according to claim 19, wherein the ratio of said time delay to said first period is less than 0.85.

22. Method according to claim 21, wherein the ratio of said time delay to said first period is equal to or less than 0.55.

23. Method according to claim 19, wherein said first time period is equal to a half resonant period of said channel.

24. Method according to claim 23, wherein the half resonant period is less than or equal to 5 $\mu$s.

25. Method according to claim 24, wherein the half resonant period is substantially equal to 2.2 $\mu$s.

26. Method according to claim 19, wherein said second time period is substantially equal to twice said first time period.

27. Method according to claim 19 and wherein the printhead has an array of said channels; the method further comprising the steps of:

applying said signal a plurality of times in accordance with print tone data, thereby to eject a corresponding number of droplets from a selected channel to form the printed dot of appropriate tone on a substrate;

said signal being repeated at such a frequency that a velocity of each ejected droplet remain both substantially independent of whether or not other channels in the array of said channels are similarly actuated to effect droplet ejection simultaneously with droplet ejection from said selected channel and substantially independent of the number of droplets to be ejected in accordance with the print tone data.

28. Method according to claim 27, wherein successive chambers in the array are regularly assigned to groups such that a chamber belonging to any one group is bounded on either side by chambers belonging to at least one other group, the groups of chambers being sequentially enabled for actuation in successive periods;

wherein signals are applied to said selected chamber at a frequency such that the velocity of the corresponding ejected droplet is both substantially independent of whether or not those chambers belonging to the same group as the selected chamber and which are located nearest in the array to said selected chamber are similarly actuated to effect droplet ejection simultaneously with drop ejection from the selected channel, and substantially independent of the number of droplets to be ejected in accordance with the print tone data.

29. Method according to claim 19 and wherein the printhead has an array of said chambers; the method further comprising the steps of:

applying said first part of said signal to the means of a selected chamber for such a time period that a velocity of the corresponding ejected droplet is both substantially independent of whether or not other channels in the array of said chambers are similarly actuated to effect drop ejection simultaneously with drop ejection from said selected channel, and substantially independent of the number of droplets to be ejected in accordance with the print tone data.

30. Method according to claim 29, wherein successive chambers in the array are regularly assigned to groups such that a chamber belonging to any one group is bounded on either side by chambers belonging to at least one other group; the groups of chambers being sequentially enabled for actuation in successive periods;

the method comprising the steps of applying said first part of said signal to the means of a selected chamber for such a time period that the the velocity of the corresponding ejected droplet is both substantially independent of whether or not those channels belonging to the same group as the selected channel and which are located nearest in the array to said selected channel are similarly actuated to effect droplet ejection simultaneously with drop ejection from the selected channel, and substantially independent of the number of droplets to be ejected in accordance with the print tone data.

31. Method according to claim 19, wherein the means for varying the volume of the channel acts to displace a wall of said channel.

32. Method according to claim 31, wherein said wall of said channel is displaceable transversely to a channel axis.

33. Method according to claim 32, wherein said displaceable channel wall separates two adjacent channels.

34. Method according to claim 31, wherein said means for varying the volume of the effects droplet ejection by means of acoustic waves in the droplet fluid.

35. Method according to claim 34, wherein said acoustic waves travel along an axis of the channel.

36. An inkjet printhead for printing on a substrate, the printhead having an array of channels, a series of nozzles which communicate respectively with said channels for ejection of droplets therefrom, connection means for connecting the channels with a source of ink, electrically actuable means associated with each channel for ejecting ink droplets in response to electrical signals; and a drive circuit for applying the electrical signals to the electrically actuable means in accordance with print tone data, thereby to eject the ink droplets to form a printed dot of appropriate tone on the substrate, the drive circuit being configured to apply two or more successive electrical signals to the electrically actuable means in accordance with the print tone data to effect ejection of two or more successive corresponding droplets, each corresponding to one of the successive signals, a time delay between application of the successive electrical signals being such that any variation in an average velocity at which the corresponding droplets travel to the substrate to form said printed dot remains below that which would lead to droplet placement errors detectable by an individual viewing a printed image on the substrate, regardless of how many of the corresponding droplets are ejected to form said printed dot.

37. A drive circuit for an inkjet printhead for printing on a substrate, the printhead having an array of channels, a series of nozzles which communicate respectively with said channels for ejection of ink droplets therefrom, connection means for connecting the channels with a source of ink, and electrically actuable means associated with each channel for ejecting ink droplets in response to electrical signals;

the drive circuit adapted for applying the electrical signals to the electrically actuable means in accordance with print tone data, thereby to eject ink droplets to form a printed dot of appropriate tone on the substrate, the drive circuit being configured to apply two or more successive electrical signals to the electrically actuable means in accordance with the print tone data to effect ejection of two or more successive corresponding droplets, each corresponding to one of the successive electrical signals, a time delay between application of the successive electrical signals being such that any variation in an average velocity at which the corresponding droplets travel to the substrate to form said printed dot remains below that which would lead to droplet placement errors that are detectable by an individual viewing a printed image on the substrate, regardless of how many of the corresponding droplets are ejected to form said printed dot.

* * * * *